US008281451B2

(12) United States Patent
Adams et al.

(10) Patent No.: US 8,281,451 B2
(45) Date of Patent: Oct. 9, 2012

(54) CLEANING SHEETS

(75) Inventors: Paul H. Adams, Monroe, CT (US); Jeffrey Mulreed, Shelton, CT (US); Anthony T. Sgroi, Jr., Wallingford, CT (US)

(73) Assignee: Unger Marketing International, LLC, Bridgeport, CT (US)

( * ) Notice: Subject to any disclaimer, the term of this patent is extended or adjusted under 35 U.S.C. 154(b) by 0 days.

(21) Appl. No.: 12/462,610

(22) Filed: Aug. 6, 2009

(65) Prior Publication Data

US 2010/0031463 A1 Feb. 11, 2010

Related U.S. Application Data

(63) Continuation of application No. 29/310,337, filed on Aug. 8, 2008, now Pat. No. Des. 634,905.

(60) Provisional application No. 61/188,447, filed on Aug. 8, 2008.

(51) Int. Cl.
*A47L 13/20* (2006.01)
*A47L 13/46* (2006.01)

(52) U.S. Cl. ..... 15/231; 15/209.1; 15/223; 15/224; 15/228

(58) Field of Classification Search ..... 15/208, 15/228, 231, 209.1, 223, 224
See application file for complete search history.

(56) References Cited

U.S. PATENT DOCUMENTS

| | | | | |
|---|---|---|---|---|
| 759,155 | A | 5/1904 | Burt et al. | |
| 3,015,834 | A * | 1/1962 | Marrinson et al. | 15/228 |
| 3,651,534 | A * | 3/1972 | Leland | 15/231 |
| 3,827,100 | A * | 8/1974 | Griffin et al. | 15/229.2 |
| 4,888,229 | A | 12/1989 | Paley et al. | |
| 4,951,341 | A * | 8/1990 | Shears | 15/228 |
| 5,419,015 | A | 5/1995 | Garcia | |
| 5,477,582 | A * | 12/1995 | Yamashita | 15/231 |
| D379,698 | S | 6/1997 | Freudenberg et al. | |
| 5,804,274 | A | 9/1998 | Nordin | |
| 5,887,311 | A | 3/1999 | Kresse et al. | |
| D409,343 | S | 5/1999 | Kingry et al. | |
| 5,960,506 | A | 10/1999 | Reuven | |
| 5,960,508 | A | 10/1999 | Holt et al. | |
| 6,003,191 | A | 12/1999 | Sherry et al. | |
| D423,742 | S | 4/2000 | Kingry et al. | |
| 6,048,123 | A | 4/2000 | Holt et al. | |
| 6,101,661 | A | 8/2000 | Policicchio et al. | |
| D438,355 | S | 2/2001 | Tintelnot | |
| D445,227 | S | 7/2001 | Tintelnot | |

(Continued)

FOREIGN PATENT DOCUMENTS

DE 3505020 A1 8/1986

(Continued)

OTHER PUBLICATIONS

Bona 3005, MicroPlus Microfiber Cleaning Cloths—2 pack, 9x12, EZ Vacuum, Jul. 23, 2008.

*Primary Examiner* — Randall Chin

(74) *Attorney, Agent, or Firm* — Ohlandt, Greeley, Ruggiero & Perle, LLP

(57) ABSTRACT

Cleaning sheets are provided, which attach to known wet and/or dry cleaning devices such as a mopping device. The cleaning sheets are reusable and have material and/or a geometric configuration that provides efficient cleaning performance, while maintaining a predetermined cleaning force during use.

19 Claims, 18 Drawing Sheets

U.S. PATENT DOCUMENTS

| | | | | |
|---|---|---|---|---|
| 6,258,455 | B1 | 7/2001 | Clarke | |
| 6,305,046 | B1 | 10/2001 | Kingry et al. | |
| D462,150 | S | 8/2002 | Rader et al. | |
| 6,484,346 | B2 | 11/2002 | Kingry et al. | |
| 6,513,184 | B1 | 2/2003 | Brown et al. | |
| 6,550,092 | B1 | 4/2003 | Brown et al. | |
| 6,561,354 | B1 | 5/2003 | Fereshtehkhou et al. | |
| 6,601,261 | B1 | 8/2003 | Holt et al. | |
| 6,645,604 | B1 | 11/2003 | Fereshtehkhou et al. | |
| 6,651,290 | B2 | 11/2003 | Kingry et al. | |
| 6,687,941 | B2 | 2/2004 | Billat | |
| 6,694,563 | B2 | 2/2004 | Onwugbonu | |
| D489,537 | S | 5/2004 | Wong et al. | |
| 6,797,357 | B2 | 9/2004 | Fereshtehkhou et al. | |
| D499,887 | S | 12/2004 | Wong et al. | |
| 6,936,330 | B2 | 8/2005 | Fereshtehkhou et al. | |
| 7,028,364 | B2 | 4/2006 | Policicchio et al. | |
| 7,096,531 | B2 * | 8/2006 | Policicchio | 15/228 |
| 7,132,377 | B2 | 11/2006 | Borgonjon et al. | |
| 7,191,486 | B1 | 3/2007 | Michelson et al. | |
| D604,469 | S | 11/2009 | Rolstad et al. | |
| D609,420 | S | 2/2010 | Lafortezza | |
| D618,410 | S | 6/2010 | Libman et al. | |
| 2001/0049017 | A1 | 12/2001 | Clarke | |
| 2002/0065012 | A1 | 5/2002 | Takabayashi et al. | |
| 2004/0074520 | A1 | 4/2004 | Truong et al. | |
| 2004/0159331 | A1 | 8/2004 | Katsin | |
| 2004/0163674 | A1 | 8/2004 | Policicchio et al. | |
| 2005/0039287 | A1 * | 2/2005 | Moser | 15/228 |
| 2005/0060829 | A1 | 3/2005 | Silvers et al. | |
| 2005/0241094 | A1 | 11/2005 | Olsen | |
| 2005/0241095 | A1 | 11/2005 | Olsen | |
| 2006/0064834 | A1 * | 3/2006 | Tanaka | 15/209.1 |
| 2006/0123573 | A1 | 6/2006 | Rivera et al. | |
| 2006/0183392 | A1 | 8/2006 | Silvers et al. | |
| 2006/0200933 | A1 | 9/2006 | McDonnell | |
| 2007/0061987 | A1 | 3/2007 | Kresse et al. | |
| 2007/0141299 | A1 | 6/2007 | Hong | |
| 2007/0151064 | A1 | 7/2007 | O'Connor et al. | |
| 2007/0256261 | A1 | 11/2007 | Benitez et al. | |
| 2007/0256266 | A1 | 11/2007 | Michelson et al. | |
| 2008/0047089 | A1 | 2/2008 | Sadovsky | |
| 2008/0083080 | A1 | 4/2008 | Shen et al. | |

FOREIGN PATENT DOCUMENTS

| | | | |
|---|---|---|---|
| JP | 408024191 | A | 6/1994 |
| JP | 408140913 | A | 6/1996 |
| JP | 2001299658 | | 10/2001 |
| WO | WO 94/23635 | | 10/1994 |

* cited by examiner

CLEANING SHEETS

CROSS REFERENCE TO RELATED APPLICATIONS

This application claims the benefit of U.S. Provisional Application Ser. No. 61/188,447, filed Aug. 8, 2008, and this application is a continuation of U.S. Design application Ser. No. 29/310,337, filed Aug. 8, 2008, now U.S. Pat. No. D,634,905, the contents of each of which are incorporated by reference herein.

BACKGROUND OF THE INVENTION

1. Field of the Invention

The present disclosure relates to cleaning sheets for use with dust mops and wet mops, specifically to such cleaning sheets that are configured to reduce a cleaning force and/or increase a cleaning effectiveness through geometry alternations and/or material selection.

2. Description of Related Art

There are many types of cleaning devices on the market today designed to accommodate disposable cleaning sheets. For example, cleaning devices such as the SWIFFER®, which is commercially available from Procter & Gamble, are configured to removably secure disposable cleaning sheets on the cleaning device. Such disposable cleaning sheets are typically made of non-woven fabrics.

Some of these cleaning devices are configured to accommodate disposable cleaning sheets for use with dry dusting. However, others of these cleaning devices are configured to accommodate disposable cleaning sheets for use with wet mopping. In such wet mopping configurations, the cleaning device and disposable cleaning sheets are configured for use with, for example, a cleaning solution such as water and/or a detergent to increase the overall effectiveness of the cleaning device.

The dry dusting disposable cleaning sheets are relatively inexpensive and, thus, single use of these cleaning sheets is common. Unfortunately, in order to withstand the rigors imposed by wet cleaning, the disposable cleaning sheets configured for such a use typically require multiple layers and/or more highly engineered materials, which increase the cost of such wet disposable cleaning sheets. The high cost of disposable cleaning sheets used for wet mopping has resulted in an inconvenient choice for the end user, namely to bear the high financial and environmental costs associated with disposal of the cleaning sheet after each use or, alternately, to reduce the financial and environmental costs by reusing the cleaning sheet but suffer with less than optimal cleaning results.

Accordingly, it has been determined by the present disclosure there is a need for cleaning sheets and methods that overcome, alleviate, and/or mitigate one or more of the aforementioned and other deleterious effects of the prior art.

BRIEF SUMMARY OF THE INVENTION

A reusable cleaning sheet is provided that is configured for removable connection to known cleaning devices. In some embodiments, the reusable cleaning sheet is a microfiber-cleaning sheet.

A cleaning sheet is provided that connects to a cleaning device where the cleaning sheet is made of a reusable material that mitigates friction between a surface being cleaned and the cleaning sheet during wet mopping applications.

A reusable, microfiber cleaning sheet that connects to a cleaning device is provided. The cleaning sheet includes means for reducing the friction between the microfiber cleaning sheet and the surface being cleaned. The means for reducing friction can, in some embodiments, include one or more structures, such as folds, formed on the sheet.

The above-described and other advantages and features of the present disclosure will be appreciated and understood by those skilled in the art from the following detailed description, drawings.

DETAILED DESCRIPTION OF THE INVENTION

Figure 1:
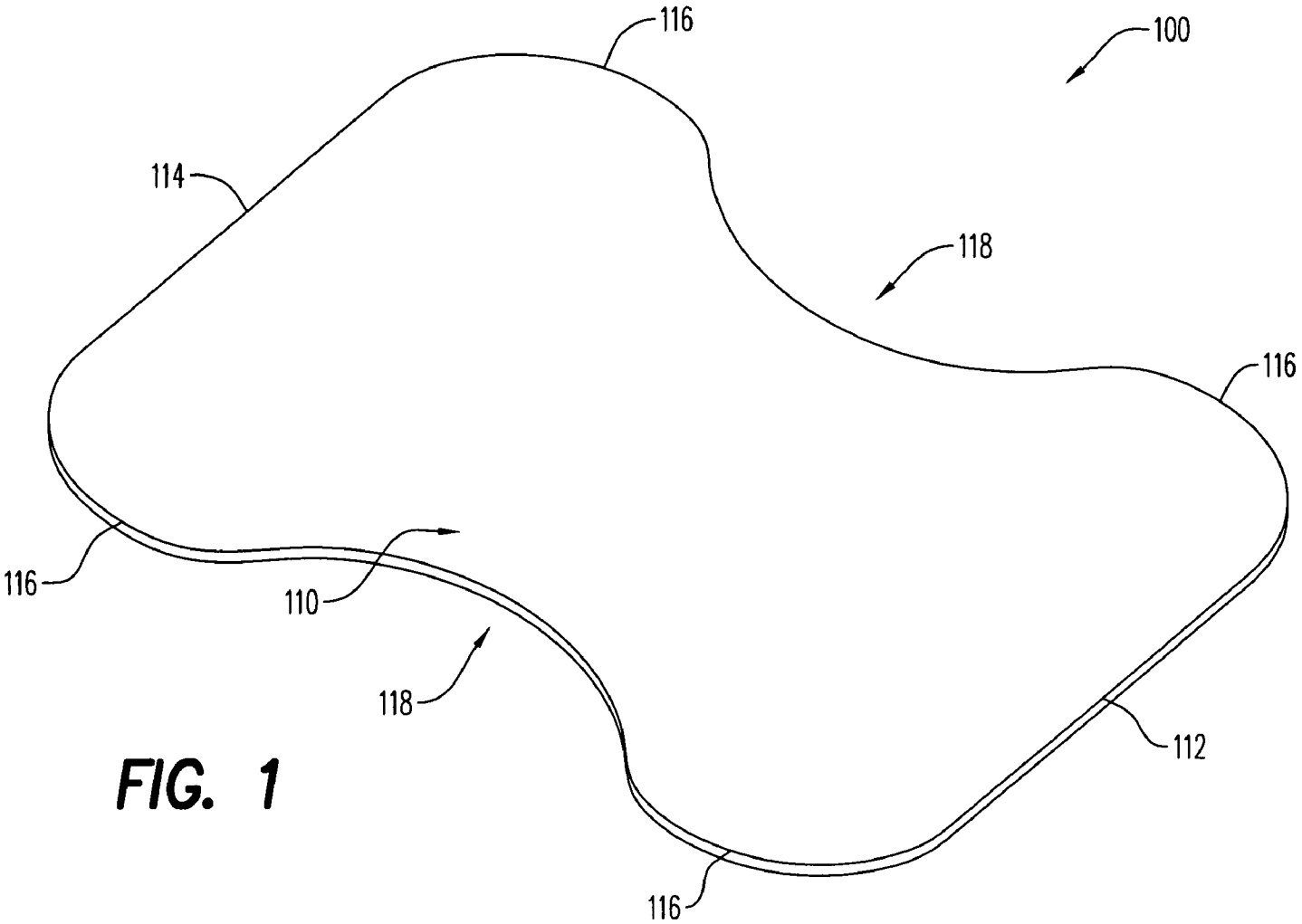
FIG. 1 is a bottom perspective view of an exemplary embodiment of a reusable cleaning sheet according to the present disclosure.
Figure 2:
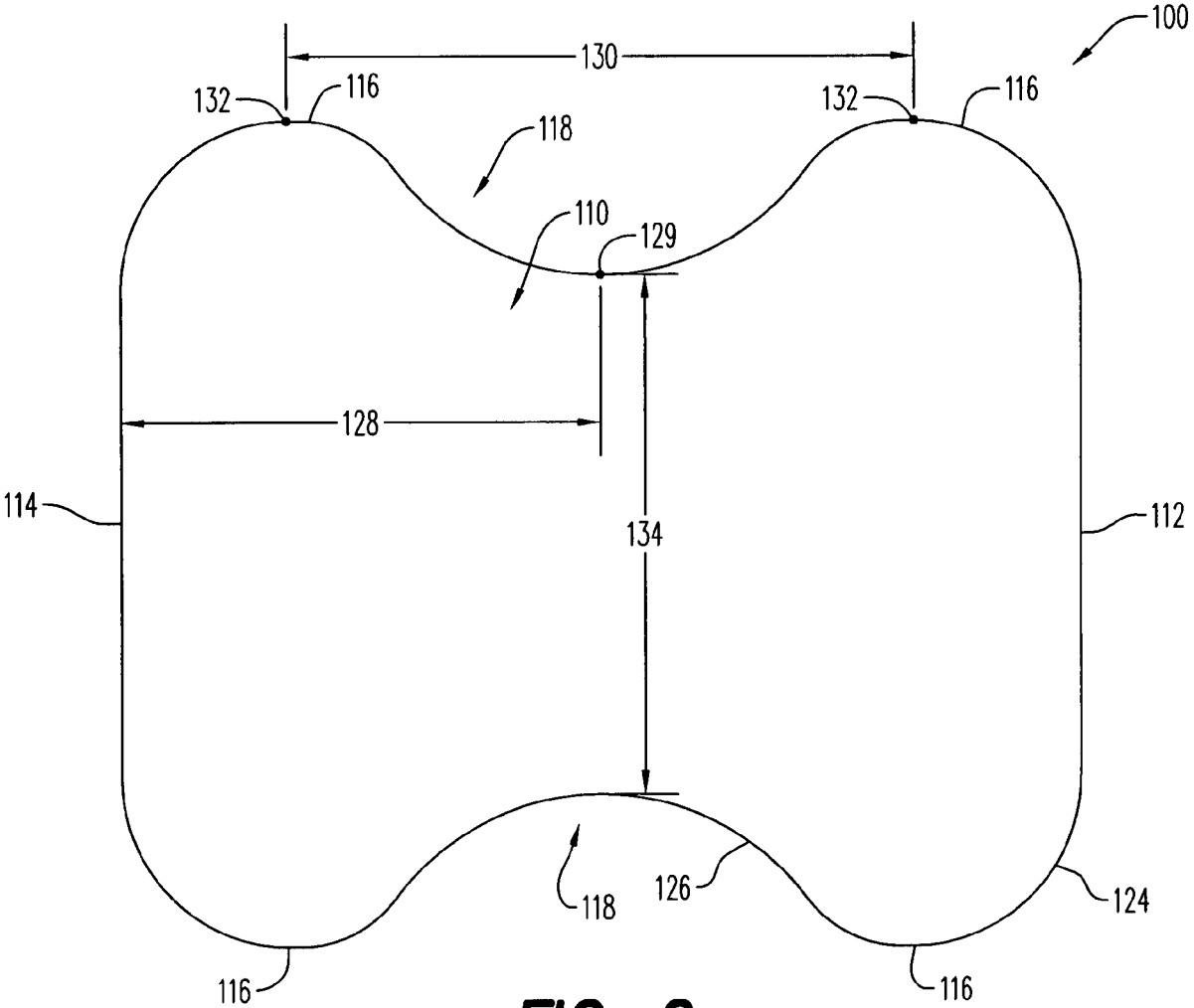
FIG. 2 is a bottom plan view of the cleaning sheet of FIG. 1.
Figure 3:
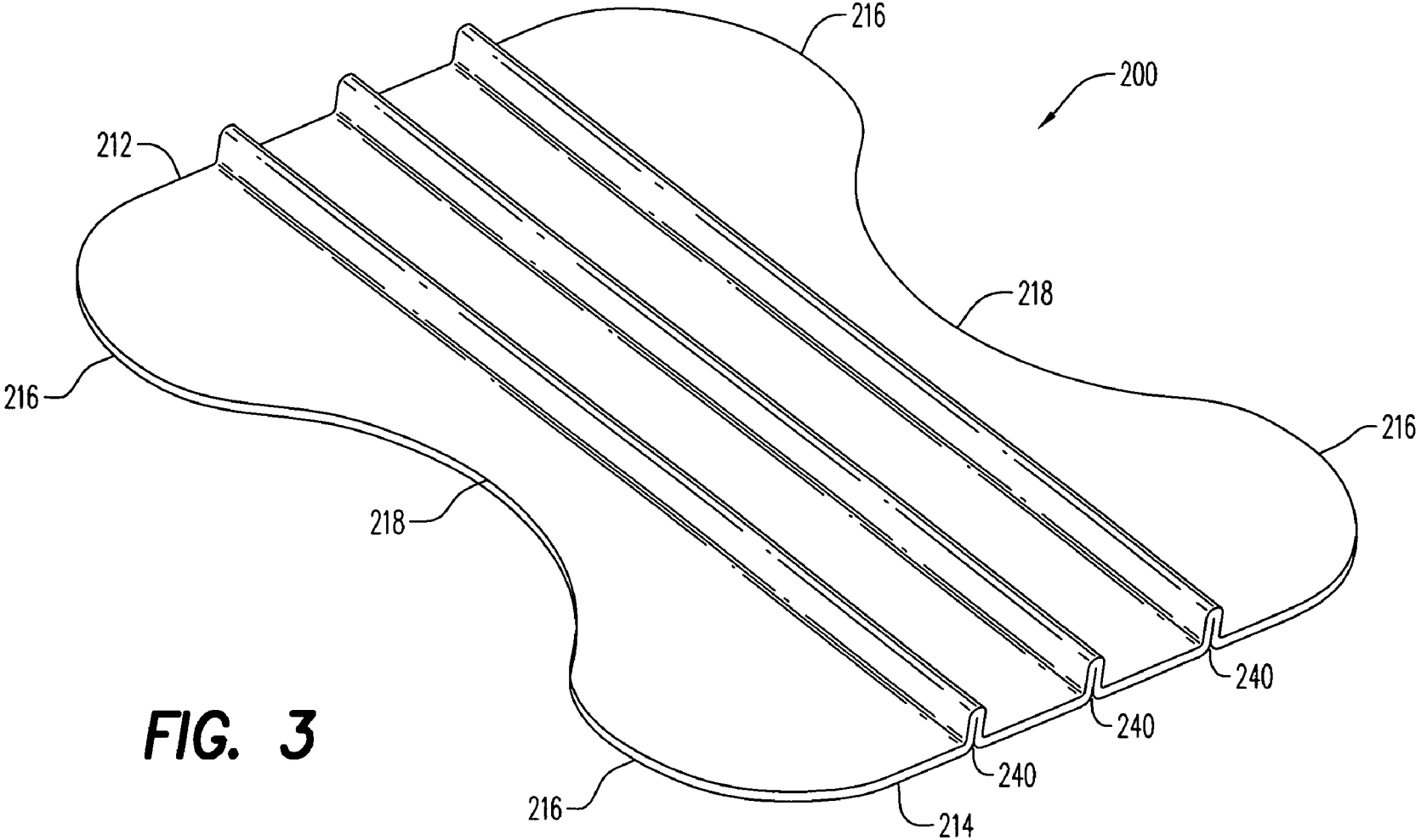
FIG. 3 is bottom perspective view of an alternate exemplary embodiment of a reusable cleaning sheet according to the present disclosure.
Figure 4:
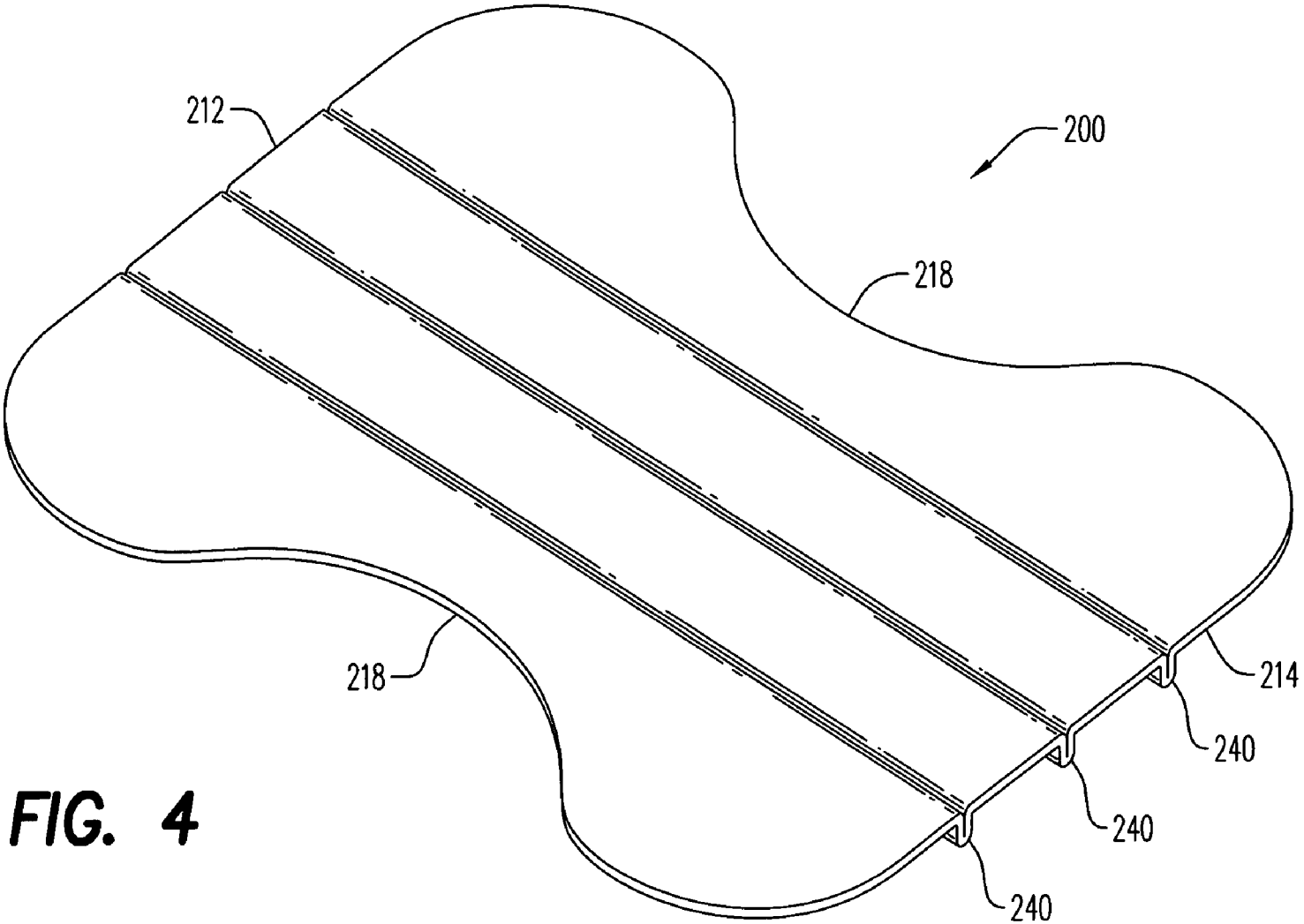
FIG. 4 is a top perspective view of the cleaning sheet of FIG. 3.
Figure 5:
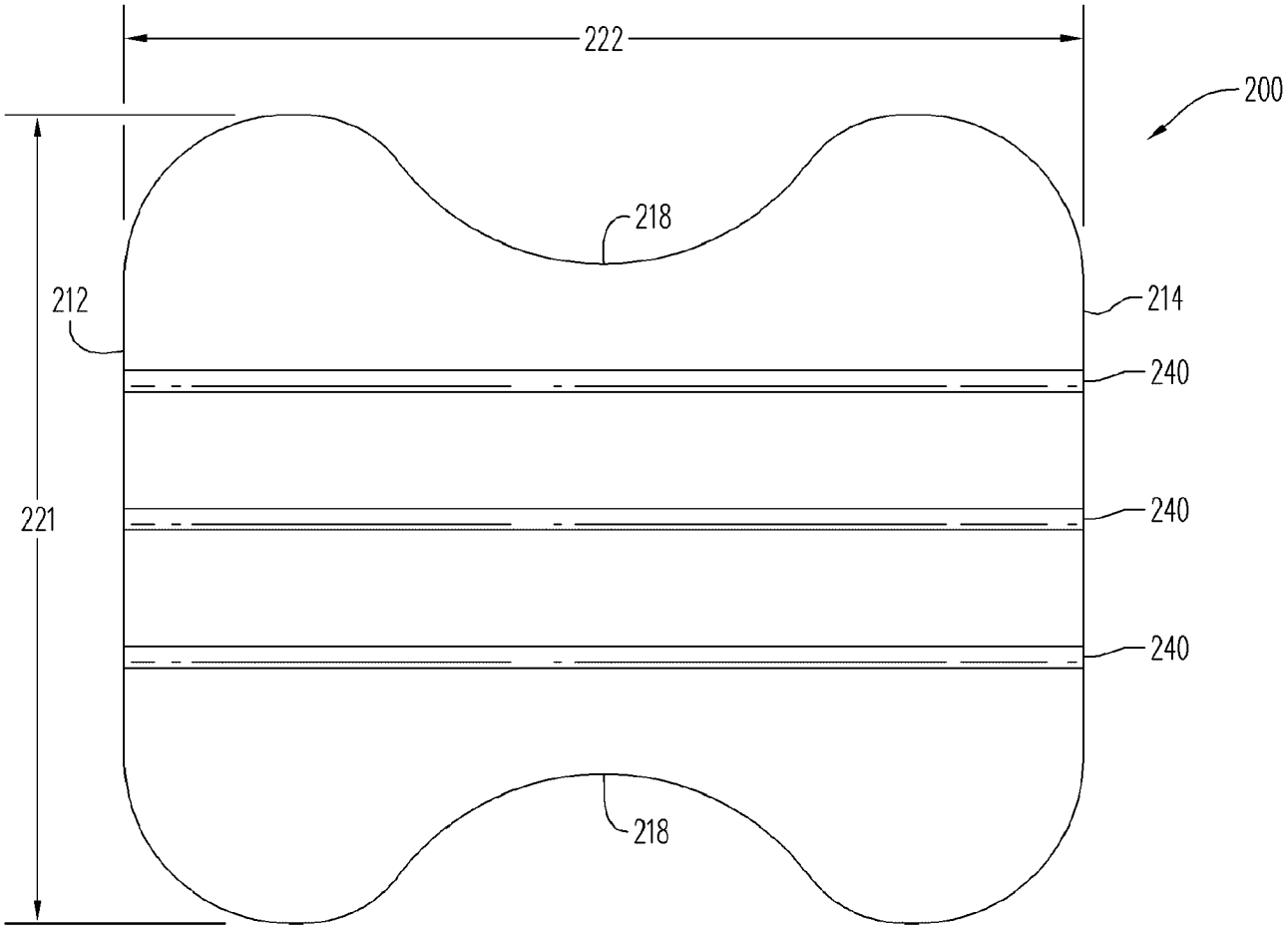
FIG. 5 is a bottom plan view of the cleaning sheet of FIG. 3.
Figure 6:
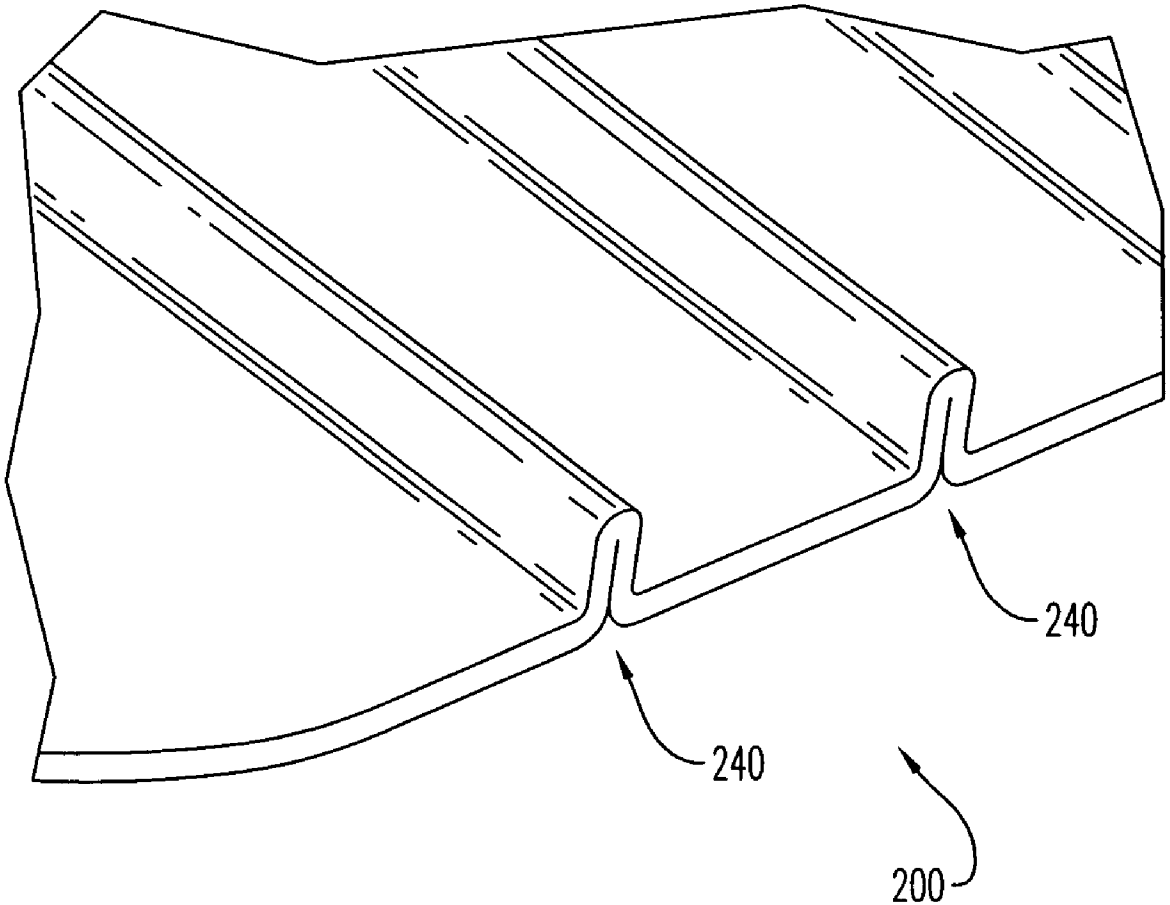
FIG. 6 is an enlarged view of the cleaning sheet of FIG. 3.

Referring to the drawings and in particular to FIGS. 1 and 2, an exemplary embodiment of a cleaning sheet according to the present disclosure is generally referred to by reference numeral 100. By way of example, cleaning sheet 100 may be used with a cleaning device such as, but not limited to those marketed under the tradename SWIFFER® sold by Procter & Gamble or the READY MOP® sold by the Clorox Company.

Advantageously, cleaning sheet 100 is configured to balance a cleaning effectiveness and a cleaning force (when in use) to allow the reusable cleaning sheet to be used in both dry dusting and wet mopping. Specifically, cleaning sheet 100 according to the present disclosure includes means for reducing the cleaning force between the cleaning sheet 100 and the surface being cleaned, while maintaining a high cleaning efficiency.

As used herein, the cleaning force shall mean the force due to friction as a result of the relative motion between the cleaning sheet 100 and the surface being cleaned. When used in dry dusting, the cleaning force is a function of dry friction, which is the force resisting the relative motion of the cleaning sheet 100 on the surface to be cleaned. However, when used in wet mopping, the cleaning force is a function of wet friction, which is the force resisting the relative motion of the cleaning sheet 100 to the cleaning fluid and the cleaning fluid to the surface to be cleaned.

Cleaning sheet 100 has a sheet body 110. Sheet body 110 has a first end 112 and a second end 114. First end 112 and second end 114 each have two connection portions 116. Each of the two connection portions 116 extend from opposite sides of each of first end 112 and second end 114. Sheet body 110 has a recess portion 118 between connection portions 116 on first end 112 and second end 114.

First end 112 and second end 114 have a width 120. Cleaning sheet 100 has length 122. Connection portions 116 have a first radius of curvature 124, while recess portions 118 have a second radius of curvature 126. There is a distance 128 between second end 114 and a point 129 where recess portions 118 form a minimum width 134. A distance 130 is between two points 132 where connection portions 116 form a maximum width. Minimum width 134 is between point 129 of each recess portion 118.

It has been found by the present disclosure that, width 120, length 122, radius of curvature 124, radius of curvature 126, distance 128, distance 130, and distance 134 can be configured to maximize compatibility with many cleaning devices currently on the market. For example, cleaning sheet 100 can be configured so that connecting portions 116 are received in a connector (not shown) of the cleaning device and so that recess portions 118 are received around the handle of the cleaning device.

In a first embodiment, cleaning sheet 100 is configured to balance the cleaning effectiveness and the cleaning force by way of a selection of materials. Here, cleaning sheet 100 includes one or more materials that are reusable and washable, for example, by hand washing or in a conventional washing machine and dryer.

Preferably, cleaning sheet 100 is single layer of a woven or knit microfiber cleaning cloth. Of course, it is contemplated by the present disclosure for cleaning sheet 100 to include more than one microfiber layer and/or for the cleaning sheet to include one or more layers not made of microfiber fabric.

Microfiber fabrics are known to be durable and can be washed more times than ordinary non-woven fabrics and, thus, are reusable as compared to the single-use disposable prior art cleaning cloths. Additionally, microfiber fabrics are known to have better cleaning performance as compared to ordinary non-woven fabrics.

As used herein, the term "microfiber" shall mean a fiber having a denier of less than one and the term "microfiber fabric" shall mean a woven fabric having such microfibers. The preferred microfiber cleaning cloth according to the present disclosure includes a "canvas" or "ground" into which a plurality of microfibers are knitted. The canvas or ground is made of regular polyester (100%) with a diameter of about three denier, while the microfibers are made of a blend of about 75% polyester (PE) and about 25% polyamide (PA) having a denier of about 0.138.

Microfibers are generally produced by knitting or weaving split multi-component conjugate filaments. The multi-component filaments are often bicomponent conjugate filaments that commonly include Polyester (PE) filaments co-extruded with a Polyamide (PA) core with a ratio of between about 70% to about 80% PE and about 20% to about 30% PA.

Before or after knitting, the microfiber fabric is exposed to a process such as, but not limited to a chemical treatment, thermal treatment, a mechanical treatment, and any combinations thereof, so that the bicomponent conjugate filaments are separated. Hence, microfiber fabrics have numerous capillaries due to the splitting of the conjugate filaments. Accordingly, microfiber fabrics rapidly absorb and transport moisture because of these capillaries.

Furthermore, the splitting of the bicomponent conjugate filaments typically increases the surface area of the fiber by creating microscopic hooks or edges, which enhance microfiber's dust and dirt removal and holding capabilities. For example, the PA core of many microfibers have a star-like shape defining a plurality of non-abrasive wedge-shaped edges. The microfiber edges are so fine that they are known to cut through dirt and grease and trap the waste within the fabric without the need for detergents or other dirt releasing chemicals.

Because of the very nature of the materials used, microfiber fabrics clean better than conventional cloths for both oil based and water based dirt. For example, PE is lyophilic and thus attracts oils to this component of the fabric, while PA is hydrophilic and, thus, attracts water to this component of the fabric.

In one embodiment of the present disclosure, cleaning cloth 100 is made entirely of microfiber fabric. In other embodiments, cleaning cloth 100 can be knit with a combination of microfibers and/or with non-microfibers. In still other embodiments, cleaning cloth 100 can be formed of portions of microfiber cloth joined to microfiber and/or non-microfiber cloth. Cleaning cloth 100 can preferably have a basis weight per unit area of about 300 grams per meter squared.

However, it has also been determined by the present disclosure that the high absorbency of cleaning cloth 100 made entirely of microfiber fabric can, when used in wet mopping applications, undesirably increase the cleaning force beyond a predetermined limit.

Without wishing to be bound by any particular theory, it is believed that at least a portion of the high absorbency of microfiber fabrics results from the capillary action of the fine denier fibers, where such capillary action itself results from surface tension between the liquid and the fiber. It is further believed, again without wishing to be bound by any particular theory, that the increased surface tension provided by the fibers also detrimentally increases the cleaning force needed to move cleaning cloth 100 across a surface during wet mopping.

It has been found by the present disclosure that the materials of cleaning sheet 100 may be utilized to reduce the cleaning force to an acceptable force that is required to be applied to a cleaning implement, for example, a mop, a surface cleaning product and/or a duster and cleaning sheet 100 to move cleaning sheet 100 on a surface so that users of cleaning sheet 100 may use less force during use. Acceptable cleaning force is defined for the purposes of this application as between about 0 pounds to about 20 pounds and any sub-ranges therebetween.

The material of cleaning sheet 100 may have antibacterial and/or antimicrobial properties. The material of cleaning sheet 100 may include the material marketed under the tradename Agion®, the material marketed under the tradename Cupron™, copper, silver, the material marketed under the tradename Microban®, and any other material having antibacterial and/or antimicrobial properties.

Referring now to FIGS. 3-9, an alternate exemplary embodiment of a cleaning sheet according to the present disclosure is shown and are generally referred to by reference numeral 200. In this embodiment, cleaning sheet 200 is configured to balance the cleaning effectiveness and the cleaning force by way of one or more loops 240 described in detail below.

Cleaning sheet 200 is similar in construction to cleaning sheet 100 with component parts performing similar and/or analogous functions being labeled in multiples of one hundred, but includes one or more loops 240. Loops 240 may be formed by folding the material of cleaning sheet 200 and securing the material folded together by a connector 220. Connector 220 can be a seam, an adhesive, and any other connecting method.

Thus, loop 240 creates a "high point" as a result of the loop folding flat against the cleaning sheet, where the high point effectively reduces a surface area of cleaning sheet 200 that contacts the surface during cleaning. Without wishing to be bound by any particular theory, it is believed that loops 240, due to a reduction of the surface area of the cleaning sheet 200 in contact with the cleaning surface, assist in mitigating the effects of surface tension on the cleaning force.

Preferably loops 240 are present in sufficient number and/or size so as to reduce the surface area of the mop by about 20% to about 95%, preferably by about 50% to about 90%, with about or 70% to 90% being most preferred, and any subranges therebetween.

It should be recognized that cleaning cloth 100 is described by way of example utilizing only a selection of materials (e.g., microfibers integrally knit with non-microfibers and/or microfiber fabrics sewn to non-microfiber and/or microfiber fabrics) while cleaning cloth 200 is described by way of example utilizing only loops 240. Of course, it is contemplated by the present disclosure for the cleaning cloth to include both a selection of materials as described with respect to cloth 100 and loops 240 as described with respect to cloth 200.

Figure 7:
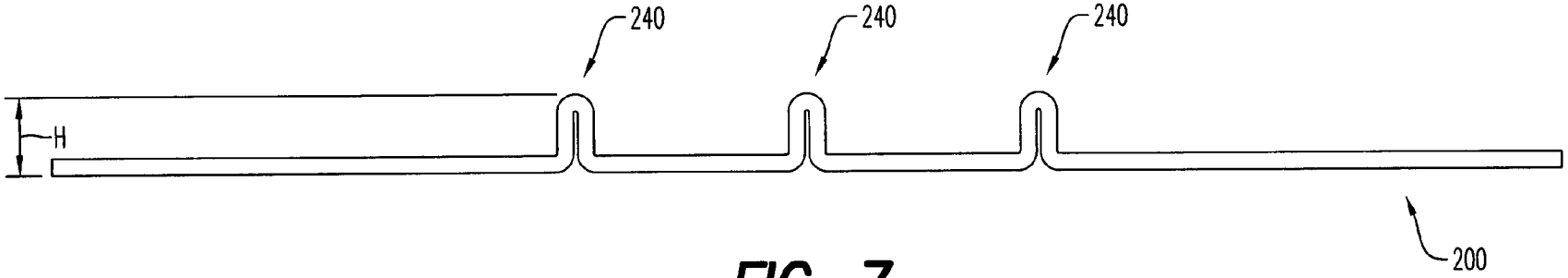
FIG. 7 is a side view of the cleaning sheet of FIG. 3.
Figure 8:
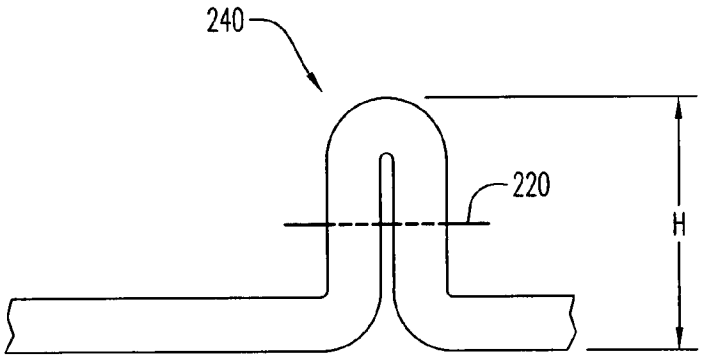
FIG. 8 is an enlarged view of the cleaning sheet of FIG. 7.

Cleaning cloth 200, as shown in FIGS. 3-8, includes one or more loops 240 (three shown) formed by folding the material along a length 222 of cleaning sheet 200. Loop 240 may have a height (H) of about 0.1 inches to about 2 inches, preferably about 0.15 inches to about 1.5 inches, more preferably about 0.2 inches to about 1.0 inches, with about 0.25 inches to about 0.5 inches being most preferred, and any subranges therebetween. In other embodiments, loop 240 may have a height (H) that is approximately 25% of the total surface area of the cleaning cloth. The height (H) of loop 240 is measured from a bottom of cleaning sheet 200 to a top of loop 240 as shown in FIGS. 7 and 8.

Cleaning sheet 200 preferably has three loops, one of the loops 240 may be in a center of a width 221 of the sheet and two loops 240 may be spaced about 40 millimeters (mm) on each side of the center loop 240. Of course, it is contemplated by the present disclosure for cleaning sheet 200 to include more or less than three loops. Further, it is contemplated by the present disclosure for loop 240 to be at any location on cleaning sheet 200, such as, for example, adjacent first end 212 and/or second end 214.

Figure 9:
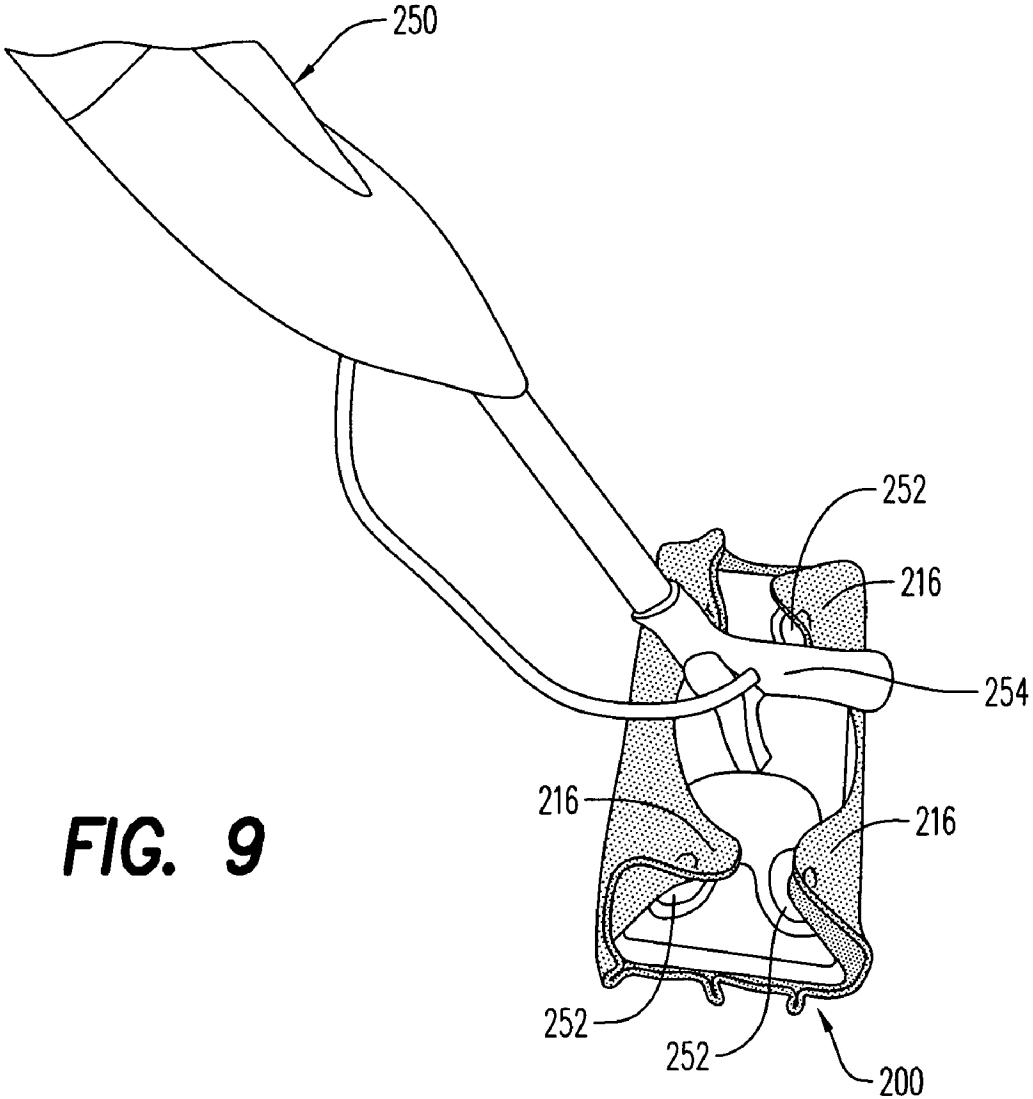
FIG. 9 is a top perspective view of the cleaning sheet of FIG. 3 connected to a mop.
Figure 10:
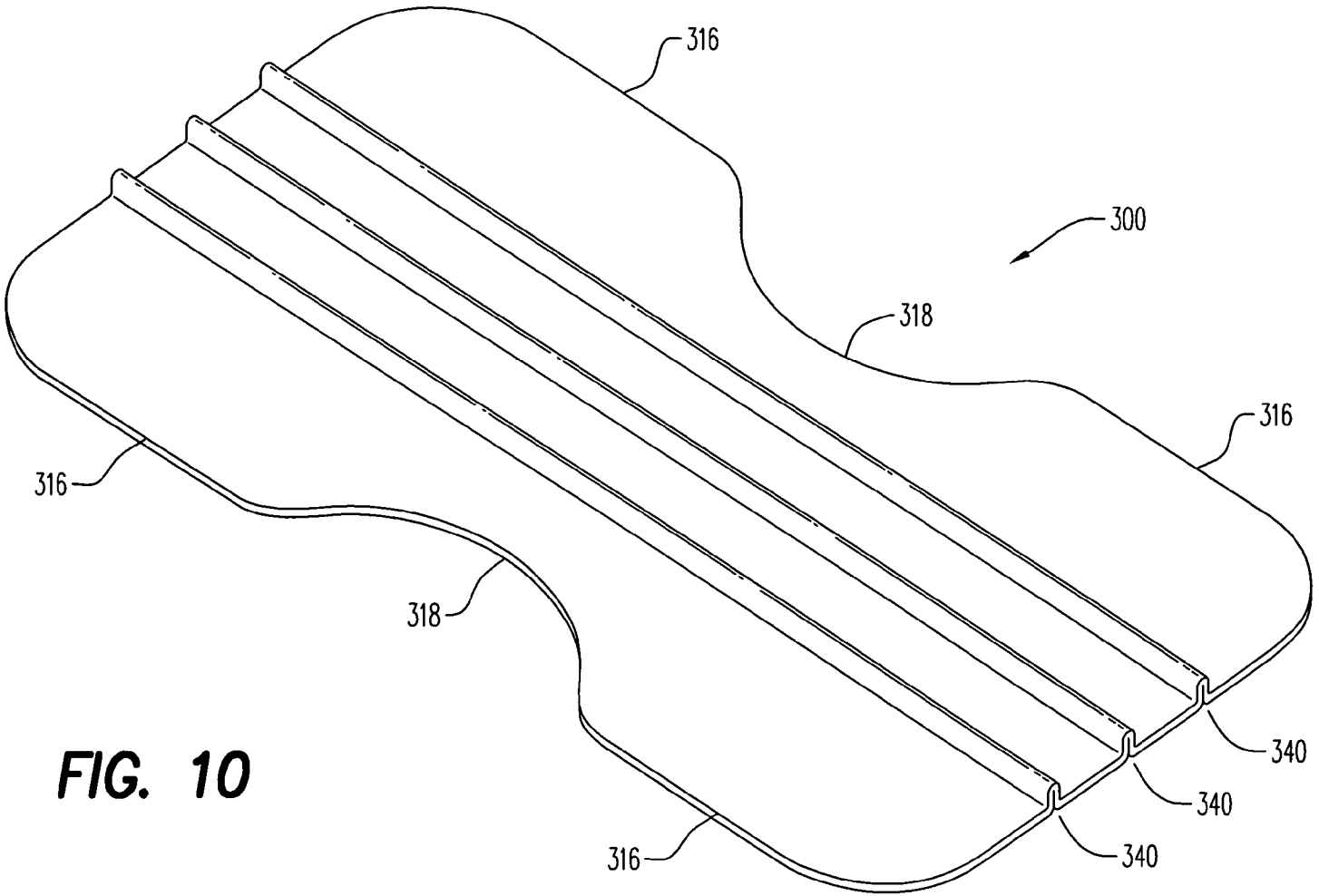
FIG. 10 is bottom perspective view of another alternate exemplary embodiment, of a reusable cleaning sheet according to the present disclosure.
Figure 11:
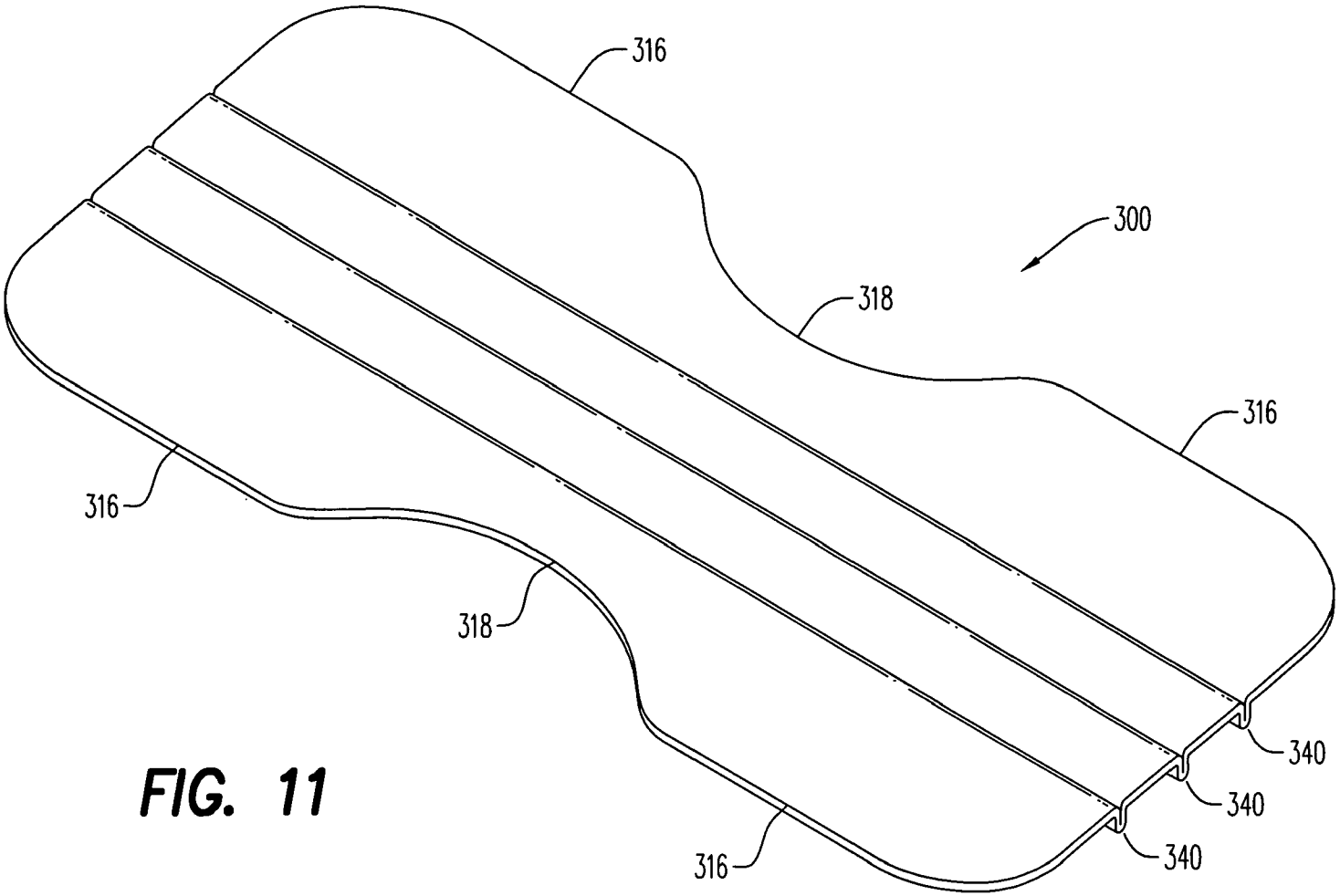
FIG. 11 is a top perspective view of the cleaning sheet of FIG. 10.
Figure 12:
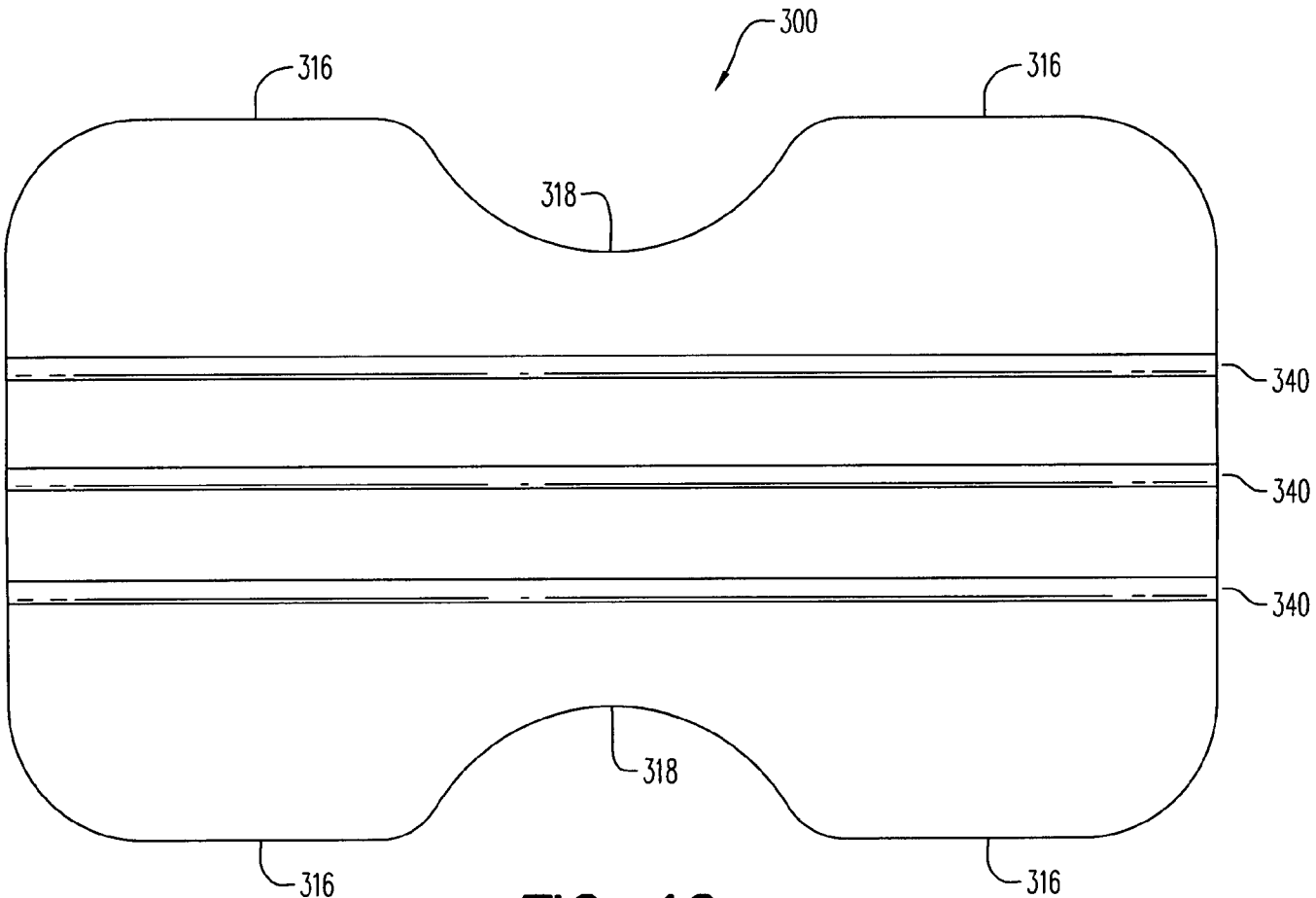
FIG. 12 is a bottom plan view of the cleaning sheet of FIG. 10.
Figure 13:
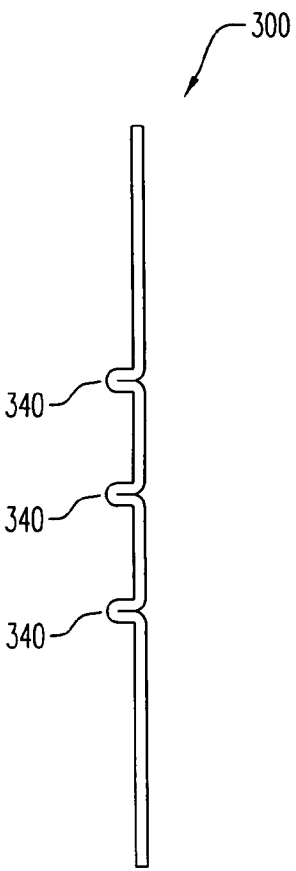
FIG. 13 is a side view of the cleaning sheet of FIG. 10.
Figure 15:
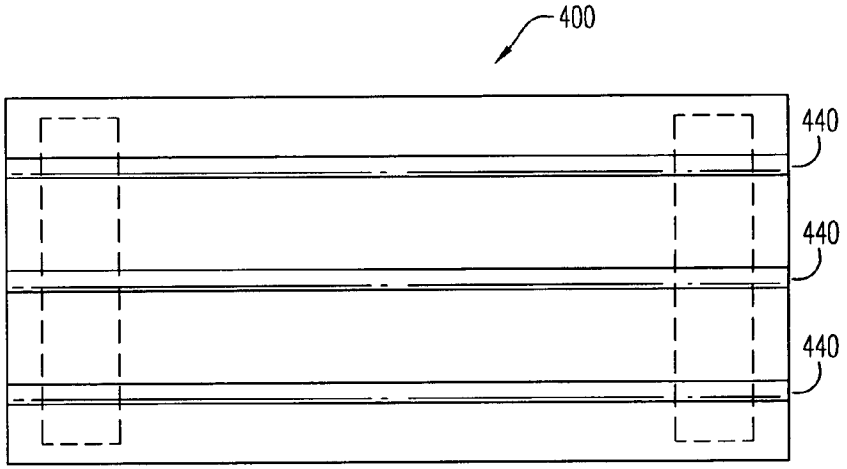
FIG. 15 is a bottom plan view of the cleaning sheet of FIG. 14.
Figure 17:
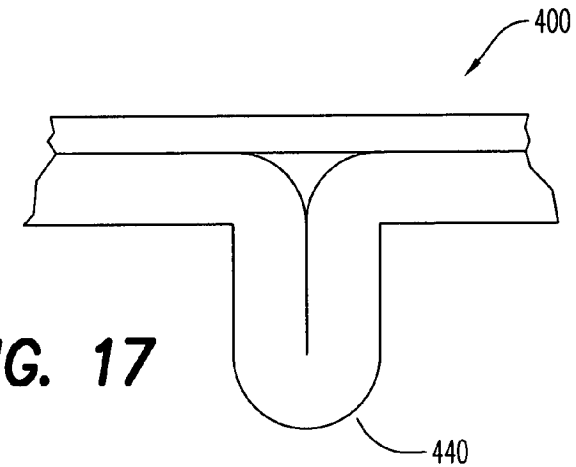
FIG. 17 is an enlarged view of the cleaning sheet of FIG. 16.
Figure 14:
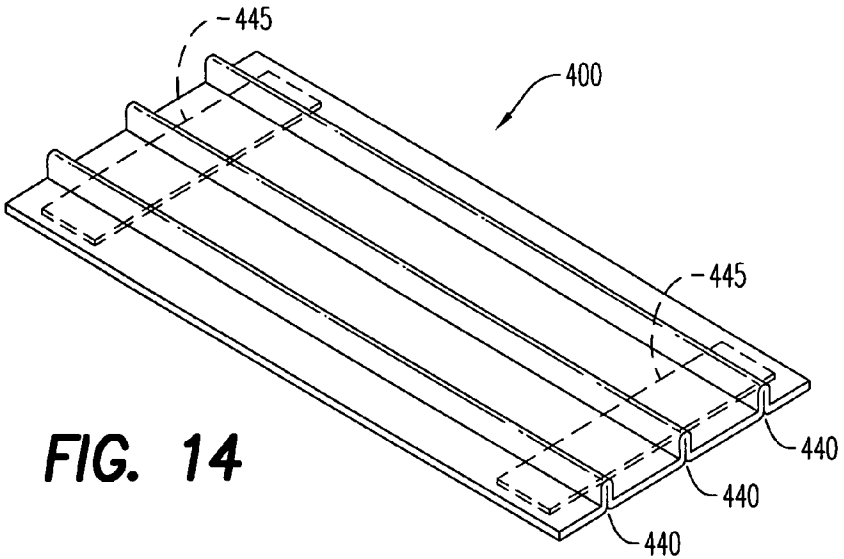
FIG. 14 is bottom perspective view of an alternate exemplary embodiment of a reusable cleaning sheet according to the present disclosure.
Figure 16:
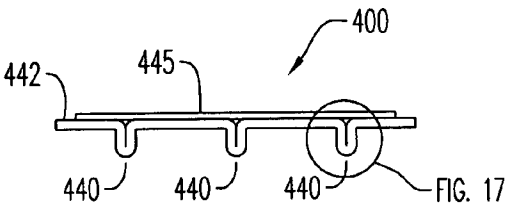
FIG. 16 is a side view of the cleaning sheet of FIG. 14.

Cleaning sheet 200 is configured to include connecting portions 216 and recess portions 218. Thus, cleaning sheet 200, when in use with a cleaning device 250 shown in FIG. 9, is configured so that connecting portions 216 can be received in a connector 252 of the cleaning device and so that recess portions 218 are received around a handle 254 of the cleaning device.

As shown in FIGS. 3-9, loops 240 are preferably made of one continuous piece of fabric. However, it is also contemplated by the present disclosure for loops 240 to be in an intermittent or discontinuous pattern in the cleaning sheet as is described in more detail below. Further, it is contemplated by the present disclosure for loops 240 to include one or more openings as is described in more detail below. In still other embodiments, loops 240 may be formed by securing multiple sheets of material secured together as is described in more detail below.

Referring now to FIGS. 10-13, an alternate exemplary embodiment of a reusable cleaning cloth according to the present disclosure is shown and is generally referred to by reference numeral 300. Cleaning sheet 300 is similar in construction to cleaning sheets 100 and 200 with component parts performing similar and/or analogous functions being labeled in multiples of one hundred.

In this embodiment, cleaning sheet 300, much like cleaning sheet 200 discussed in detail above, is configured to balance the cleaning effectiveness and the cleaning force by way of one or more loops 340. Further, cleaning sheet 300 includes connecting portions 316 and recess portions 318. Here, cleaning sheet 300 is configured so that connecting portions 316 can be secured to multiple connection points on a top surface of the cleaning device in a known manner. Thus, cleaning sheet 300 is configured for use with a cleaning device such as that shown in FIG. 9.

It should be recognized that cleaning sheets 100, 200, 300 of the present disclosure are discussed by way of example only having connecting portions 116, 216, 316 and recess portions 118, 218, 318. However, it is contemplated by the present disclosure for the cleaning sheet to be configured for connection to the cleaning device in any desired manner. For example, an alternate exemplary embodiment of reusable cleaning sheet is shown in FIGS. 14-18 and is referred to by reference numeral 400. In this embodiment, cleaning sheet is configured for connection to a bottom surface of a cleaning device 450 by way of one or more connecting members such as hook-and-loop type fasteners 445.

Thus, cleaning sheet 400 retains loops 440 for reducing the cleaning force but lacks the connecting portions 116, 216, 316 and recess portions 118, 218, 318 of the prior embodiments. Rather, cleaning sheet 400 includes a top surface 442 opposite the side on which loops 440 are disposed. Top surface 442 includes one or more connecting members 445 that are connectable to a standard hook-and-loop type fastener (not shown) on a bottom surface of cleaning device 450 in a known manner so that loops 440 are directed towards the surface to be cleaned. It should be recognized that connecting members 445 are described by way of example only as being connectable to standard hook-and-loop type fasteners. Of course, it is contemplated by the present disclosure for connecting members 445 to be any fastener suitable for connecting cleaning sheet 400 to cleaning device 450.

In some embodiments, top surface 442 of cleaning sheet 400 can be made of any fabric that attaches directly to a hook side or a loop side of such a hook-and-loop type fastener. In one preferred embodiment, cleaning sheet 400 is made of microfiber fabric, which has been found by the present disclosure to attach directly to a hook side of such hook-and-loop type fasteners.

In other embodiments, cleaning sheet 400 is not made of fabric that connects directly to either the hook side or the loop side of the hook-and-loop type fastener. In these embodiments, cleaning sheet 400 can include a hook portion or a loop portion secured thereto in a known manner for connection to cleaning device 450.

It should also be recognized that loops 240, 340, 440 are shown by way of example as being formed from one continuous piece of fabric and in a continuous or linear pattern. However, it is also contemplated by the present disclosure for the reusable cleaning sheet of the present disclosure to have loops that are in an intermittent or discontinuous pattern in the cleaning sheet, in a non-linear pattern, and/or to include one or more openings.

Figure 18:
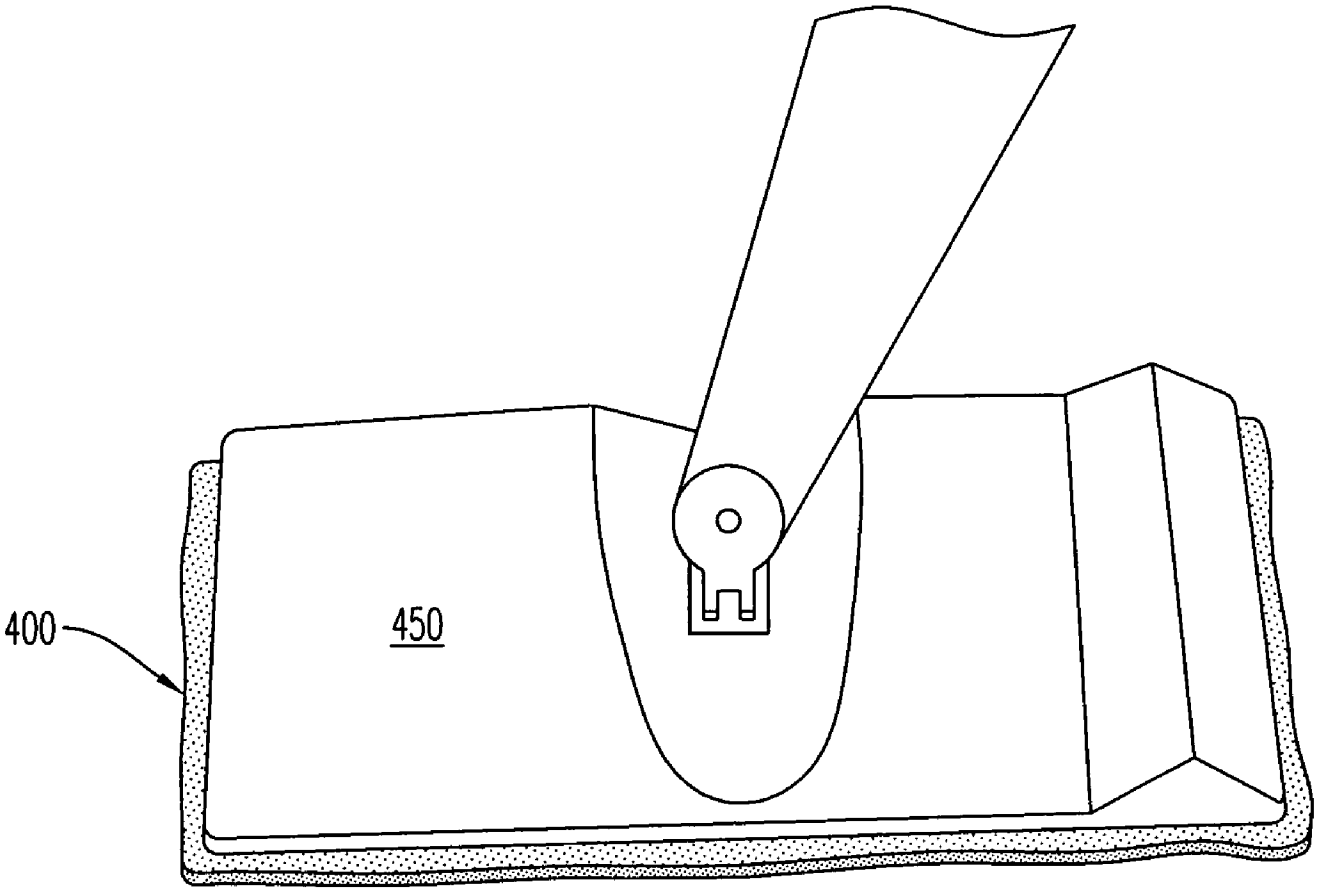
FIG. 18 is a top perspective view of the cleaning sheet of FIG. 14 connected to a mop.
Figure 19:
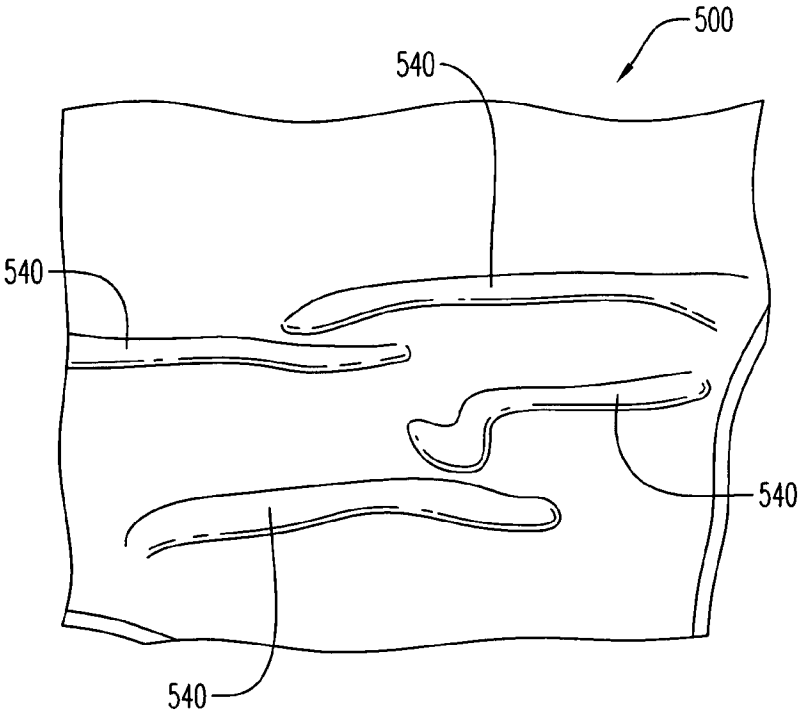
FIG. 19 is a bottom perspective view of another alternate exemplary embodiment of a reusable cleaning sheet according to the present disclosure.

For example, and referring to FIG. 19, a cleaning sheet 500 is shown having loops 540 disposed in an intermittent pattern having an orientation that is vertical, horizontal, diagonal, patterned, rectangular, polygon, circular, random or any combination thereof. Cleaning sheet 500 can be configured for use with cleaning devices such as those of FIG. 9 or FIG. 18.

Figure 20:
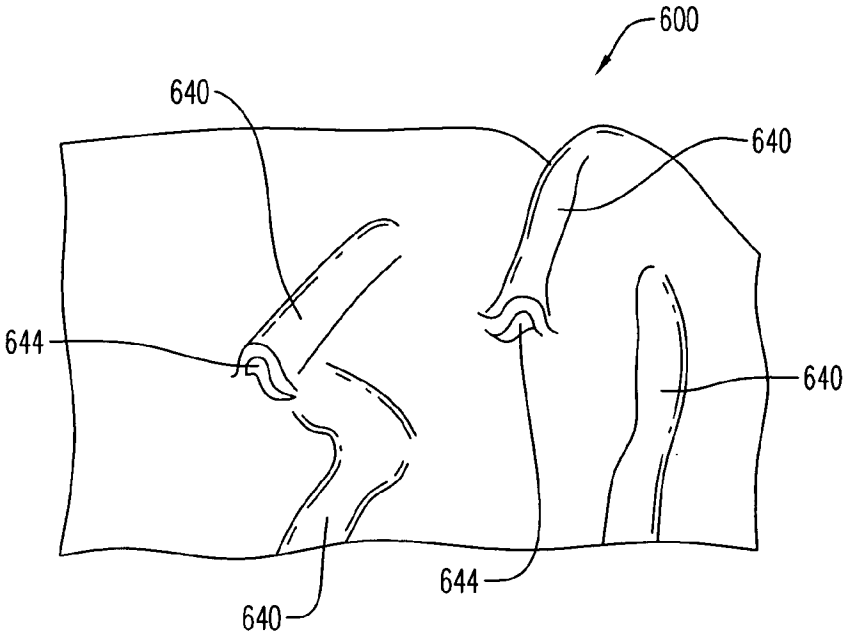
FIG. 20 is a bottom perspective view of yet another alternate exemplary embodiment of a reusable cleaning sheet according to the present disclosure.

Similarly, in the embodiment of FIG. 20, a cleaning sheet 600 is shown having loops 640 disposed in an intermittent pattern having an orientation that is vertical, horizontal, diagonal, patterned, rectangular, polygon, circular, random or any combination thereof. Here, the reduction of the surface area of cleaning sheet 600 is further enhanced by including a plurality of openings 644 on loops 640. It has also been found by the present disclosure that openings 644 generate additional edges or flaps that assist in the cleaning action and reduction of the cleaning force. For example, opening 644 can be formed by first forming loop 640 and then cutting the loop at an apex portion of the loop to define two flaps from each loop. Cleaning sheet 600 can also be configured for use with cleaning devices such as those of FIG. 9 or FIG. 18.

Figure 22:
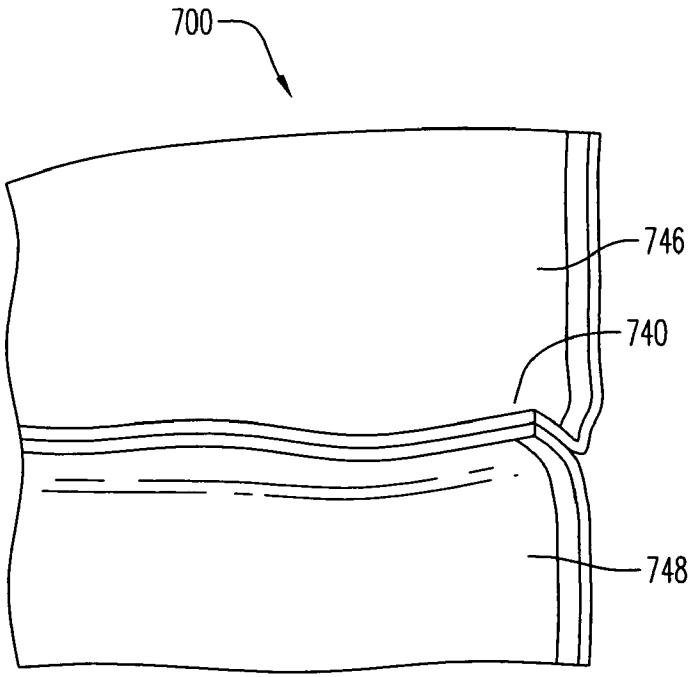
FIG. 22 is a side view of the cleaning sheet of FIG. 21.
Figure 21:
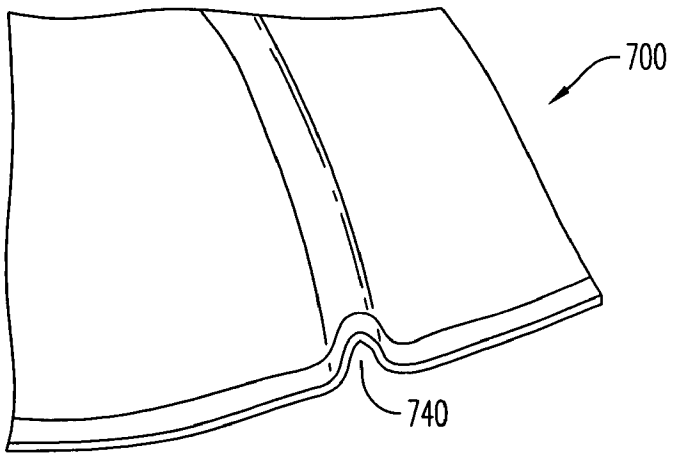
FIG. 21 is a bottom perspective view of still another alternate exemplary embodiment of a reusable cleaning sheet according to the present disclosure.

In still another embodiment shown in FIGS. 21 and 22, cleaning sheet 700 can have loops 740 formed by securing multiple sheets 746 and 748 of material secured together at the loop. It is contemplated by the present disclosure for loop 740 to have the first side 746 and the second side 748 formed of different materials. Cleaning sheet 700 can also be configured for use with cleaning devices such as those of FIG. 9 or FIG. 18.

Figure 23:
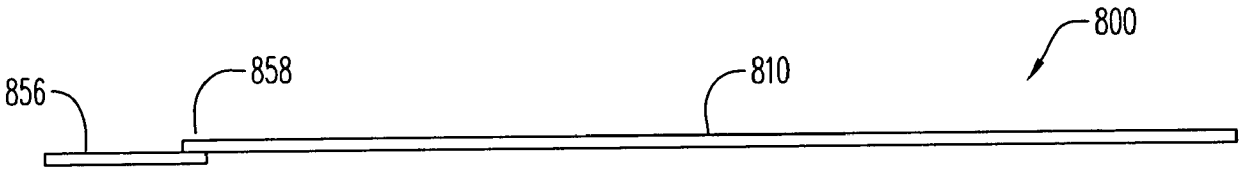
FIG. 23 is a side view of yet another exemplary embodiment of a reusable cleaning sheet according to the present disclosure.
Figure 24:
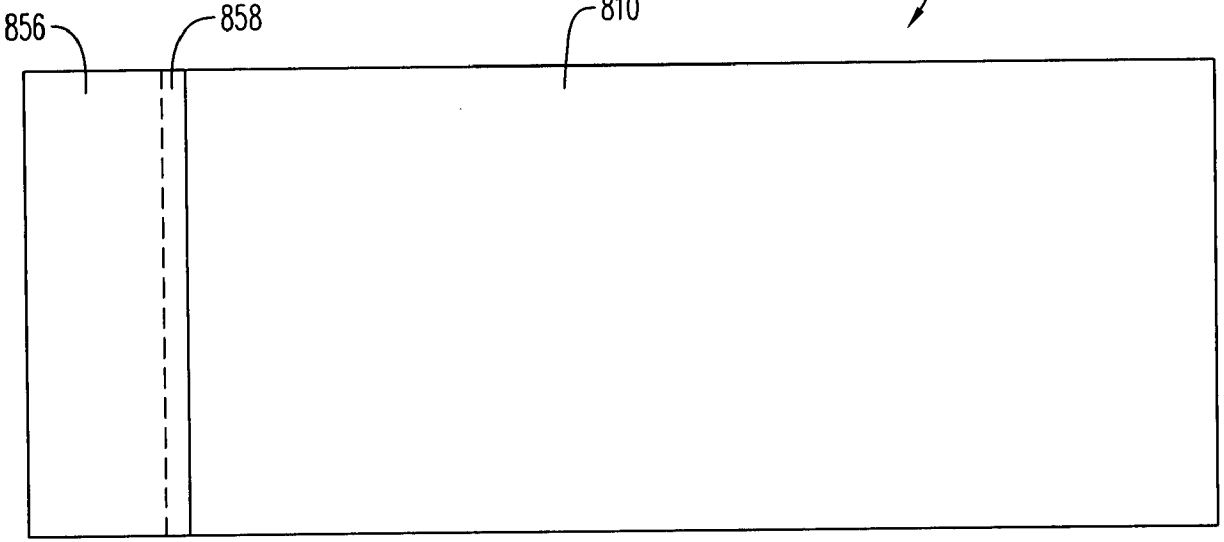
FIG. 24 is a bottom view of the cleaning sheet of FIG. 23.

Referring now to FIGS. 23 and 24, an exemplary embodiment of a cleaning sheet according to the present disclosure is generally referred to by reference numeral 800. Cleaning sheet 800 is similar to cleaning sheets 100, 200, and 300, but includes a scrubber portion 856.

Scrubber portion 856 may create more abrasion to the surface being cleaned than sheet body 810. Scrubbing portion 856 may be connected to a top surface of sheet body 810 creating a connection 858 that is thicker or thinner than sheet body 810. In other embodiments, scrubbing portion 856 can abut sheet body 810 (not shown).

Scrubbing portion 856 may be on a side portion of sheet body 810, as shown in FIGS. 23-24, or may be along a length of the sheet body or any desired position.

Scrubbing portion 856 can be made out of polyester, felt, PA, polypropylene (PP), rayon, any combinations thereof or other material with or without an abradent known in the art. Abradent can include, but is not limited to, walnut, Aluminum Oxide, silicon carbide, ceramic, silica, and combinations thereof. Scrubbing portion 856 can be made of material that is knit or woven into the material of the cleaning sheet, can be attached adjacent to the cleaning sheet, can be attached on top of the cleaning sheet material, and any combinations thereof. Connection 858 can be made by sewing, gluing, or any other attachment method sufficient to secure the abradent to the cloth.

Cleaning sheet 800 allows the user to only to handle one cleaning sheet that can be easily placed on the cleaning sheet and scrubbing pad on the mop.

Referring now to FIGS. 25-30, alternate exemplary embodiments to the loops disclosed with respect to FIGS. 1-24 are shown. Here, cleaning sheet 1200 can include one or more loops 1240. However, instead of the loops being defined by folds as discussed in detail above, one or more loops 1240 are defined by securing one or more protruding members 1241 to sheet body 1210.

Thus, loop 1240, similar to the loops formed by folds and discussed above, also create a "high point" in cleaning sheet 1200, where the high point effectively reduces a surface area of the cleaning sheet that contacts the surface during cleaning. Again, without wishing to be bound by any particular theory, it is believed that loops 1240, due to a reduction of the surface area of the cleaning sheet 1200 in contact with the cleaning surface, assist in mitigating the effects of surface tension on the cleaning force.

Figure 25:
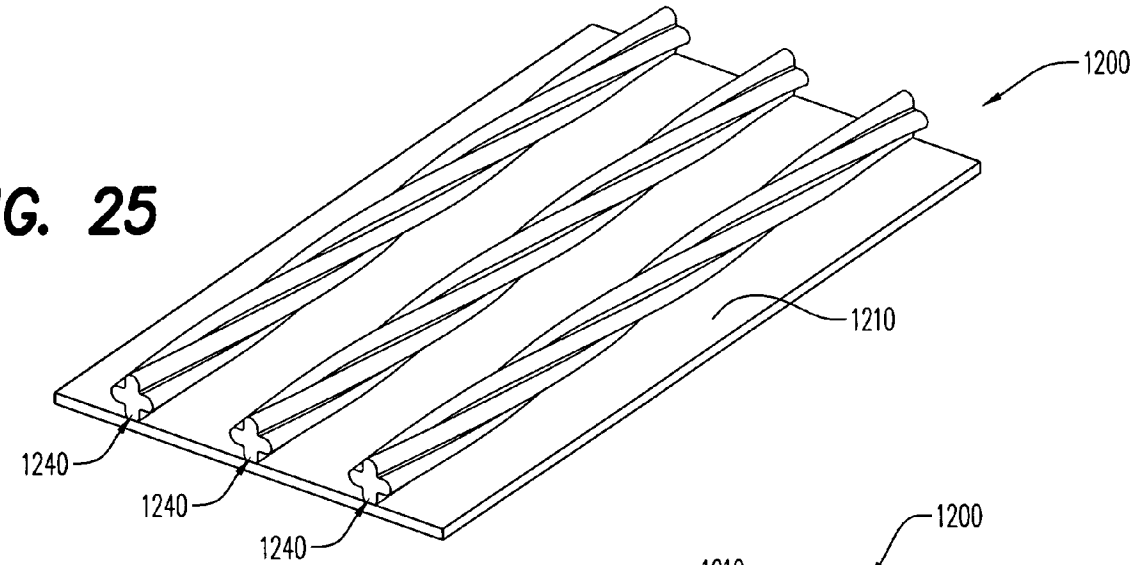
FIG. 25 is a perspective view of an alternate exemplary embodiment of a reusable cleaning sheet according to the present disclosure.
Figure 26:
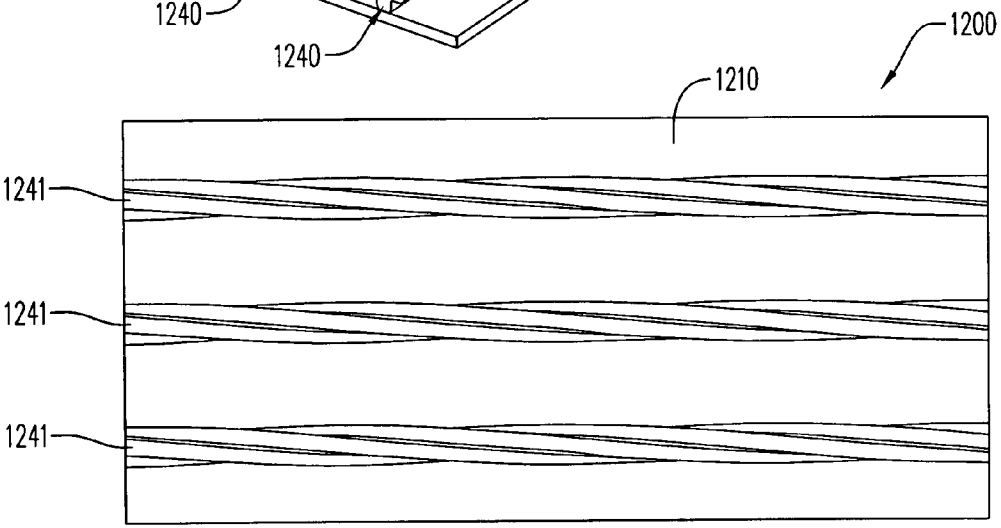
FIG. 26 is a top view of the cleaning sheet of FIG. 25.
Figure 27:
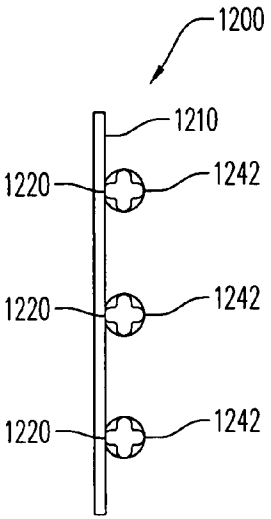
FIG. 27 is an end view of the cleaning sheet of FIG. 25.

In the embodiment of FIGS. 25-27, protruding members 1241 include a plurality of rope-shaped members 1242 connected to sheet body 1210 by a connector 1220. By way of example, rope-shaped members 1242 can be a twisted microfiber rope and connector 1220 can be a seam, an adhesive, and any other connecting method.

Figure 28:
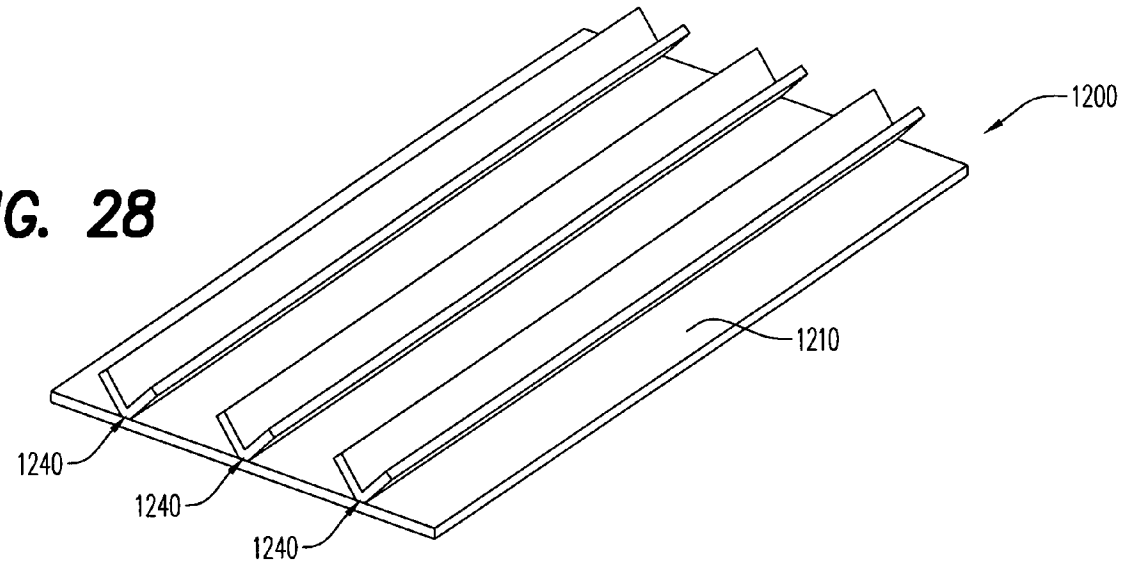
FIG. 28 is a perspective view of another alternate exemplary embodiment of a reusable cleaning sheet according to the present disclosure.
Figure 29:
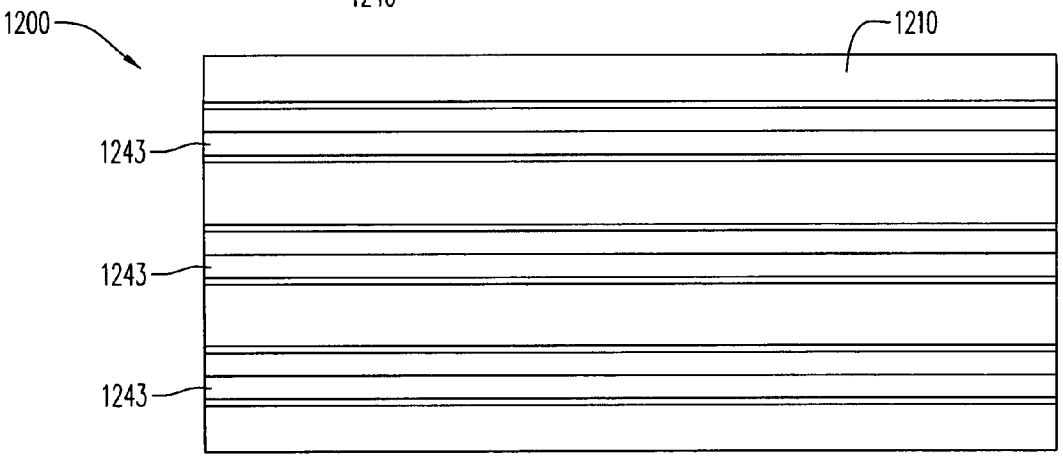
FIG. 29 is a top view of the cleaning sheet of FIG. 28.
Figure 30:
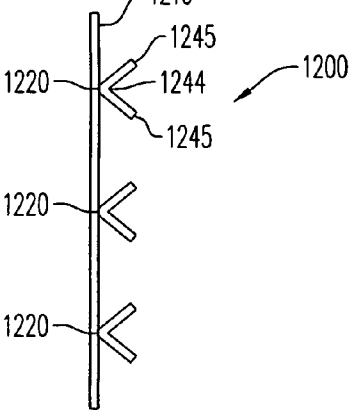
FIG. 30 is an end view of the cleaning sheet of FIG. 28.

In the embodiment of FIGS. 28-30, protruding members 1241 include a plurality of V-shaped members 1243 connected to sheet body 1210 by connector 1220. By way of example, v-shaped members 1243 can be a microfiber fabric and connector 1220 can be a seam, an adhesive, and any other connecting method. Here, connector 1220 connects a central region 1244 of the v-shaped members 1243 to sheet body 1210 to define arms 1245 of the the v-shaped members.

It should be recognized that cleaning sheet 1200 having loops 1240 formed by protruding members 1241 are shown by way of example only in a form configured to connect to a bottom of the cleaning device in the manner shown in FIG. 18. However, it is contemplated by the present disclosure for cleaning sheet 1200 to be connected to the cleaning device in any desired manner, including the manner disclosed above with respect to FIG. 9.

The various embodiments of the cleaning sheet according to the present disclosure improves cleaning performance with acceptable cleaning force and is washable and, thus, reusable. The cleaning sheet may have any material that has inconsistent height and/or reduces a surface area of the cleaning sheet in contact with the cleaning surface. The cleaning sheet may be designed such that as the user applies more force to the cleaning implement the pressure (gradient) applied to the mop and cleaning sheet adjust such that the surface area in contact with the floor increases as the user applies more force. The cleaning sheet reduces a force to slide a mop across the surface being cleaned while improving the cleaning surface. A surface of the mop can be modified to have an irregular surface to reduce the surface area of the fabric in contact with the floor.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling therein.

What is claimed is:

1. A reusable and washable cleaning sheet configured for use with a cleaning device, comprising:

a sheet body comprising woven or knit microfibers, said sheet body having a first end and a second end;

one or more loops formed in said sheet body, each of said one or more loops comprising a fold of said sheet body and secured together by a connector that runs along a length of said one or more loops, at least one of said one or more loops being in a center of said sheet body; and one or more connecting members for connecting said sheet body to the cleaning device with said one or more loops remote from the cleaning device.

2. The reusable cleaning sheet of claim 1, wherein said sheet body comprises a fabric knit with said microfibers in combination with non-microfibers.

3. The reusable cleaning sheet of claim 1, wherein said microfibers comprises split multi-component conjugate filaments.

4. The reusable cleaning sheet of claim 1, wherein said one or more connecting member comprises a plurality hook type fasteners or a plurality of loop type fasteners for connection to a surface of the cleaning device.

5. The reusable cleaning sheet of claim 1, wherein said sheet body further comprises a property selected from the group consisting of an antibacterial property, an antimicrobial property, and any combinations thereof.

6. The reusable cleaning sheet of claim 1, wherein said sheet body comprises an abradent.

7. The reusable cleaning sheet of claim 1, wherein said sheet body comprises portions of microfiber cloth joined to another portion selected from the group consisting of microfiber cloth, non-microfiber cloth, an abradent containing material, and any combinations thereof.

8. The reusable cleaning sheet of claim 1, wherein said one or more loops are present in sufficient number and/or size so as to reduce a surface area of said sheet body that contacts a surface to be cleaned by about 20% to about 95%.

9. The reusable cleaning sheet of claim 1, wherein said one or more loops have a height of about 0.1 inches to about 2 inches.

10. The reusable cleaning sheet of claim 1, wherein said one or more loops are made of one continuous piece of fabric.

11. The reusable cleaning sheet of claim 1, wherein said one or more loops further comprise one or more openings defined therein.

12. A reusable and washable cleaning sheet configured for use with a cleaning device, comprising:

a sheet body comprising woven or knit microfibers, said sheet body having a first end and a second end;

one or more loops formed in said sheet body, each of said one or more loops comprising a fold of said sheet body and secured together by a connector, at least one of said one or more loops being in a center of said sheet body; and one or more connecting members for connecting said sheet body to the cleaning device with said one or more loops remote from the cleaning device, wherein said one or more connecting members comprise two connecting portions at each of said first and second ends and a recess portion between each of said connecting portions on said first end and said connecting portions on said second end.

13. A reusable and washable cleaning sheet configured for use with a cleaning device, comprising:

a sheet body having four connecting portions, two of said four connecting portions being disposed at a first end and two of said four connecting portions being disposed at a second end with a recess defined in sides of said sheet body between said connecting portions, said sheet body comprising woven or knit microfibers; and one or more folds defined in said sheet body and secured together by a connector that runs along a length of said one or more folds, wherein said four connecting portions are configured for receipt in connectors on a top surface of the cleaning device so that said recess portions are received around a handle of the cleaning device and said one or more folds are between the cleaning device and a surface to be cleaned.

14. The reusable cleaning sheet of claim 13, wherein said sheet body comprises a fabric knit with said microfibers in combination with non-microfibers.

15. The reusable cleaning sheet of claim 13, wherein said microfibers comprises split multi-component conjugate filaments.

16. The reusable cleaning sheet of claim 13, wherein said sheet body comprises portions of microfiber cloth joined to another portion selected from the group consisting of microfiber cloth, non-microfiber cloth, an abradent containing material, and any combinations thereof.

17. A reusable and washable cleaning sheet configured for use with a cleaning device, comprising:

a sheet body comprising woven or knit microfibers;

a loop formed at a center of said sheet body, said loop comprising a fold of said sheet body along an entire length of said sheet body that is secured together by a connector; and a plurality of connecting members for connecting said sheet body to the cleaning device with said loop between the cleaning device and a surface to be cleaned.

18. The reusable cleaning sheet of claim 17, wherein said loop has a height that is approximately 25% of a total surface area of said sheet body.

19. The reusable cleaning sheet of claim 17, wherein said loop has sufficient size so as to reduce a surface area of said sheet body that contacts the surface to be cleaned by about 70% to about 90%.

* * * * *